US007143555B2

(12) United States Patent
Miller

(10) Patent No.: US 7,143,555 B2
(45) Date of Patent: Dec. 5, 2006

(54) HYBRID PRECAST CONCRETE AND METAL DECK FLOOR PANEL

(76) Inventor: Philip Glen Miller, 3548 Adrienne La., Lake Charles, LA (US) 70606

( * ) Notice: Subject to any disclaimer, the term of this patent is extended or adjusted under 35 U.S.C. 154(b) by 163 days.

(21) Appl. No.: 10/262,072

(22) Filed: Oct. 2, 2002

(65) Prior Publication Data

US 2003/0093965 A1 May 22, 2003

Related U.S. Application Data

(60) Provisional application No. 60/326,225, filed on Oct. 2, 2001.

(51) Int. Cl.
*E04B 1/00* (2006.01)

(52) U.S. Cl. ..... 52/252; 52/326; 52/336; 249/28; 249/50

(58) Field of Classification Search ..... 52/321, 52/326, 327, 332, 333, 334, 335, 336, 338, 52/340, 252, 450, 783.11, 602, 251, 414; 249/28, 50

See application file for complete search history.

(56) References Cited

U.S. PATENT DOCUMENTS 918,699 A * 4/1909 Ransome ..... 52/236.7
1,101,188 A * 6/1914 Kahn ..... 52/692
1,959,119 A * 5/1934 Young ..... 52/335
1,990,157 A * 2/1935 Young ..... 52/322
2,268,311 A * 12/1941 Sheehan ..... 52/339
3,864,888 A * 2/1975 Tupper et al. ..... 52/745.05
3,890,750 A * 6/1975 Berman et al. ..... 52/127.3
4,628,654 A * 12/1986 Boswel ..... 52/319
4,682,458 A * 7/1987 Sparrow ..... 52/309.8
4,685,264 A * 8/1987 Landis ..... 52/252
5,317,846 A * 6/1994 Michlovic ..... 52/220.4
5,941,035 A * 8/1999 Purse ..... 52/263
6,098,359 A * 8/2000 Stodulka ..... 52/252
6,128,878 A * 10/2000 Erickson ..... 52/319
6,508,043 B1 * 1/2003 Bond et al. ..... 52/742.14
6,568,139 B1 * 5/2003 Bot ..... 52/250
6,578,343 B1 * 6/2003 Dumler et al. ..... 52/783.17
6,631,599 B1 * 10/2003 Takagi ..... 52/579
2004/0074022 A1 * 4/2004 Tokuno et al. ..... 14/73

* cited by examiner

*Primary Examiner*—Carl D. Friedman
*Assistant Examiner*—Yvonne M. Horton
(74) *Attorney, Agent, or Firm*—Patton Boggs LLP

(57) ABSTRACT

In one implementation of the present invention, corrugated metal deck panels are attached to concrete structural beams to form a precast panel.

5 Claims, 4 Drawing Sheets

PARTIAL TOP VIEW

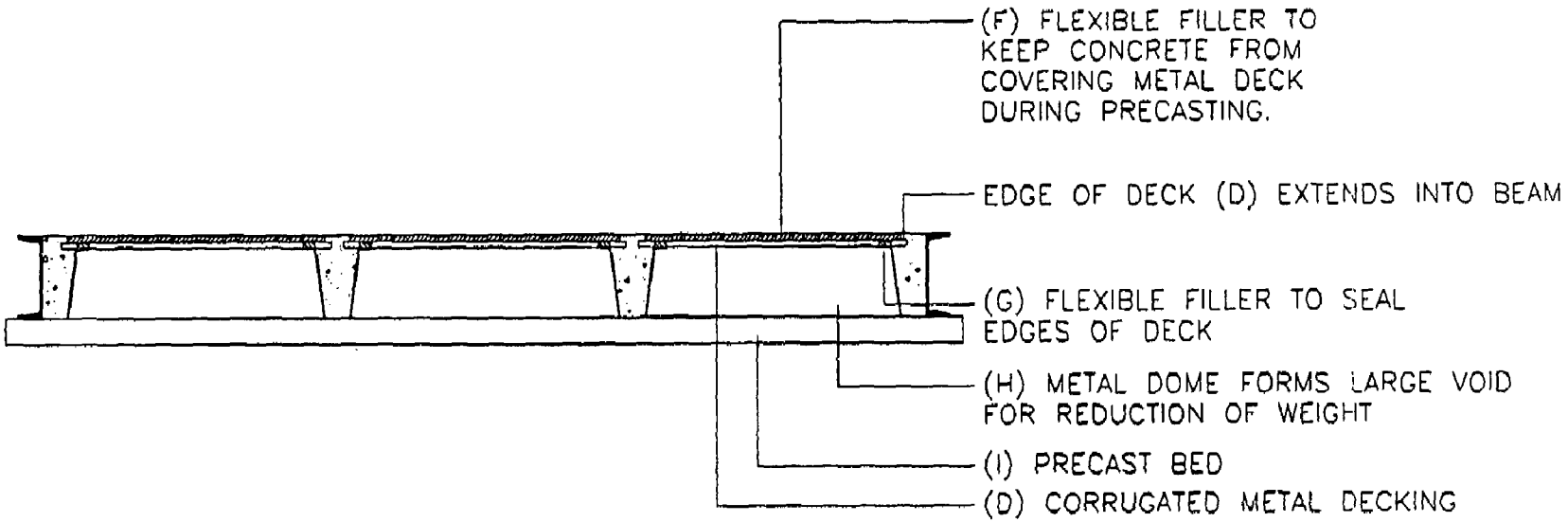
FIG. 1: SECTION IN PRECAST MOLD

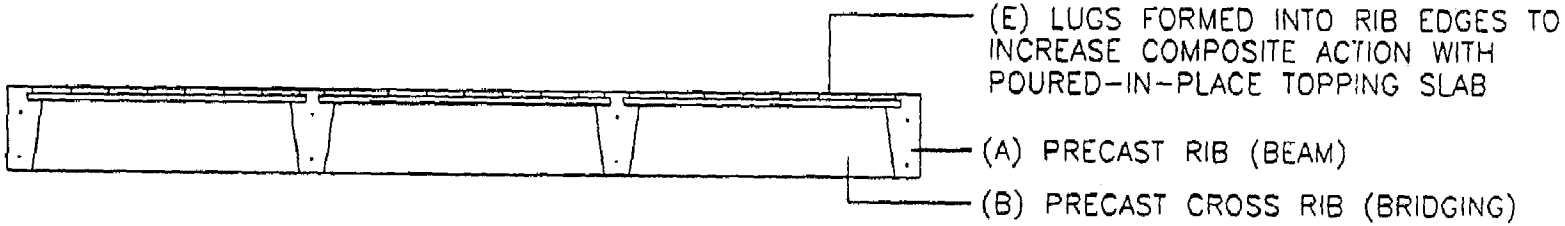
FIG. 2: SECTION OF PRECAST PRODUCT

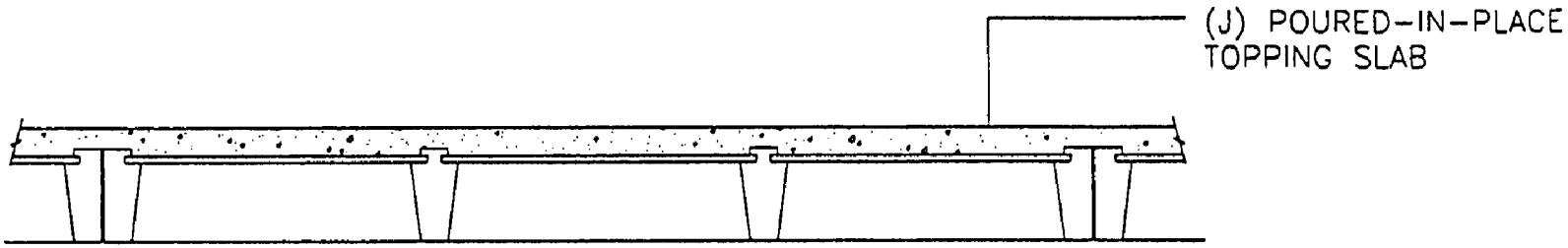
FIG. 3: SECTION FINAL FLOOR ASSEMBLY

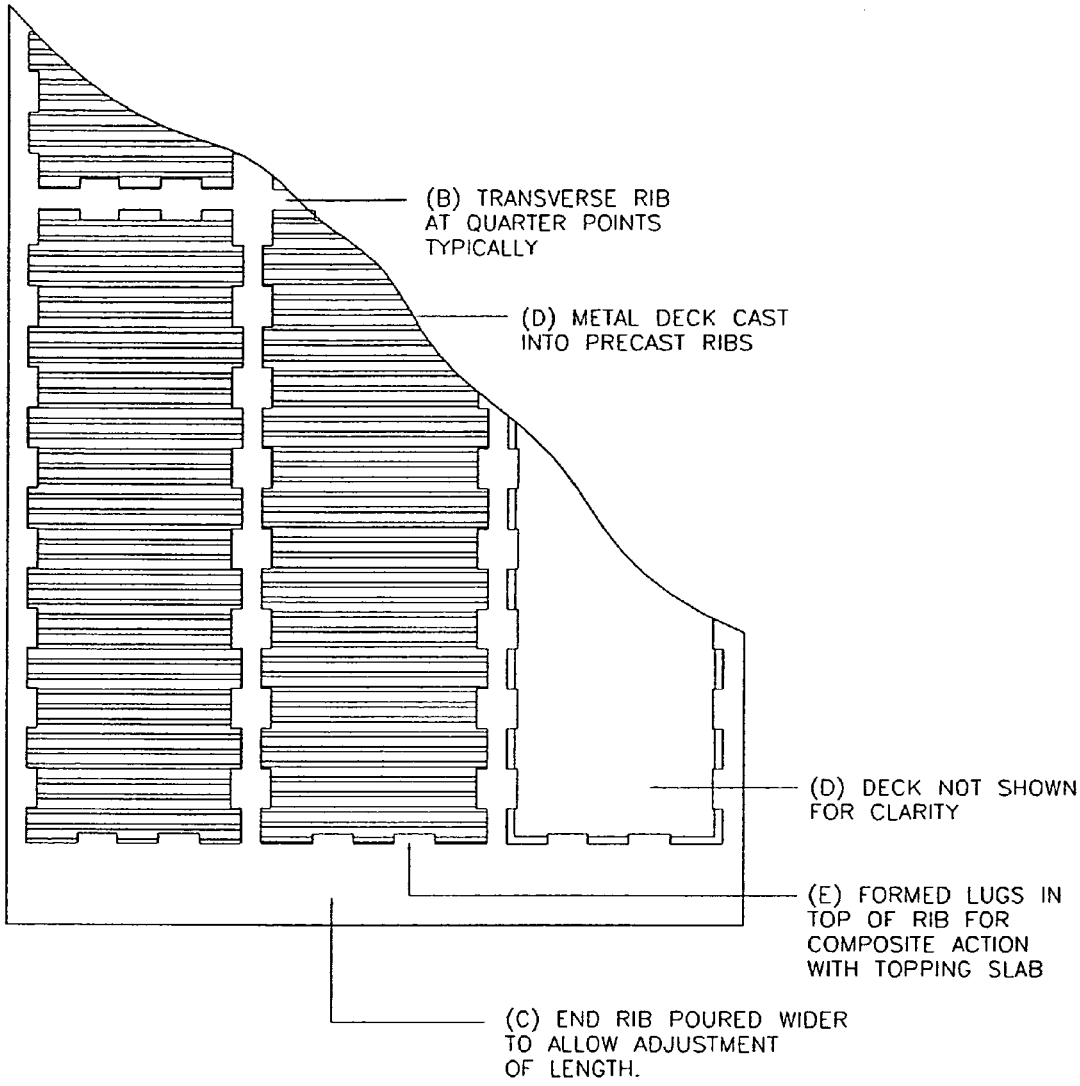
FIG. 4: PARTIAL TOP VIEW

HYBRID PRECAST CONCRETE AND METAL DECK FLOOR PANEL

This application claims the benefit of U.S. Provisional Application No. 60/326,225, filed Oct. 2, 2001.

FIELD OF THE INVENTION

The present invention relates in general to precast panels. In particular, the present invention relates to panels having precast concrete beams and a corrugated metal deck.

BACKGROUND OF THE INVENTION

It is known to use certain methods for building concrete floor slabs on the above grade floors of multi-story buildings. One method simply builds forms in place, pours the floor slab, and removes the forms after the slab reaches sufficient strength. Pans are used to form voids in the floor slab to reduce weight, while maintaining strength. This method allows the floor system to be inherently fireproof, to create thin floor sections, and to be reusable. This method, however, is costly, requires long construction times, and provides for a floor system having a heavy selfweight.

Another method involves creating a structural system with steel beams or open web joists, attaching corrugated metal decking to provide a form and casting the floor on the decking. The decking and the structural supports remain in place. This method allows for low selfweight, relatively fast construction, and relatively low cost. This method, however, requires the steel beams or joists to be fireproofed, the overall floor system to be relatively deep (often causing the building to be taller), and mechanical systems that usually run below the floor joists (which further increases building height).

Another method involves making a precast concrete element having a portion of the floor slab in its construction, placing the element(s) on structural supports and casting a thin topping slab over the slab portion for the final finished floor. The precast elements include single tees, double tees, hollow-core slabs, and flat slabs. The resulting floor system is fireproof, has a relatively fast construction time, and allows for offsite fabrication of large floor components. This method, however, is costly, expensive to transport, and, in the case of tees, results in a relatively deep floor system.

BRIEF DESCRIPTION OF THE DRAWINGS

In the drawings, like reference numerals represent similar parts of the illustrated embodiments of the present invention throughout the several views wherein:

FIG. 1 depicts one embodiment of a section of a precast panel in a mold;

FIG. 2 depicts one embodiment of a product produced by a precast mold;

FIG. 3 depicts one embodiment of a sectional view of a completed floor system; and FIG. 4 depicts one embodiment of a partial, top view of a completed floor system.

DETAILED DESCRIPTION

One embodiment of the present invention provides for a structural panel system (e.g., a structural floor system) that combines precast concrete structural beams (e.g., ribs) for load capacity with corrugated metal deck to provide a diaphragm and a form for a poured-in-place concrete topping slab. The embodiment combines the construction speed and offsite fabrication of precast elements with low self-weight, similar to steel structure and deck, with the relatively shallow depth and fire resistance of cast-in-place systems. The embodiment can provide for the best features of known methods, discussed above, without their respective disadvantages.

In one implementation of the present invention, a hybrid precast/steel deck panel includes structural ribs in a longitudinal direction that may provide primary spanning capacity, with minor ribs in a transverse direction that may provide lateral stability to the longitudinal ribs. These beam elements may be formed to lock small panels of corrugated steel deck into the rib elements permanently. The edges of the upper section of the ribs may be cast with an undulating pattern to interlock the rib with the poured-in-place slab, resulting in a composite action between the rib and the poured-in-place slab. The full depth of the system (e.g., a floor system) may be the effective beam depth. These ribs may be reinforced, prestressed, and/or post-tensioned, as loads and conditions dictate.

The corrugated steel deck panels may serve as the structural diaphragm of the individual panels during handling, shipping, and/or erection. The corrugated steel deck panels may also serve as a permanent form for the poured-in-place topping slab. The floor slab may be poured to the thickness required for load and fireproofing requirements. The deck may also be fireproofed after erection to allow for thinner floor slabs.

The panels may be fabricated in standard precast beds, where they can be prestressed. These panels have a low self-weight, as the metal deck may weigh 1 or 2 pounds per square foot as compared to 25 to 30 pounds for the 2" deck on tees or 50 pounds for hollow core slabs. This low self-weight provides for less expensive shipping and allows for smaller equipment to erect the panels.

The formed lugs in the upper edge of the beams may form a composite with the poured-in-place slab to allow for a thinner overall floor system. The corrugated metal deck may be fireproofed if a thinner overall floor thickness is needed. This allows for a single mold to accommodate a greater variety of loading conditions. The concrete floor slab may also be penetrated for piping, conduits, and/or ducts, unlike post tensioned cast-in-place floors.

FIG. 1 illustrates one embodiment of a section of a precast panel in a mold (I). Domes (H) (e.g., metal domes) form void areas (e.g., large void areas) between longitudinal ribs (A) (see FIG. 2) and transverse ribs (B) (see FIG. 2). Affixed to the top edges of the void forms (H) are flexible gaskets (G) having an undulating upper surface that meshes with the corrugations in the corrugated steel deck (D). After the corrugated steel deck (D) is placed on the flexible gasket (G), a flexible mat (F) is placed on top of the metal deck (D) to prevent concrete from covering the deck. The flexible mat (F) has an undulating surface that meshes into the corrugations of the deck (D) to provide a seal. The flexible mat (F) includes a notched pattern on all four edges that forms the composite lugs (E) (see FIG. 2) on the top edges of the longitudinal (A) and transverse (B) ribs (see FIG. 2) forming a shear key to provide composite action with the poured-in-place concrete floor (J) (see FIG. 3). The edges of the metal deck panels (D) extend a distance (e.g., a small distance) past the lower flexible gasket (G) and the upper flexible mat (F) so that when the concrete ribs are poured, that edge becomes embedded to lock the deck into place. After casting, the flexible mats (F) are removed, leaving the deck clean. The panel is then removed from the mold yielding the finished product, illustrated in FIG. 2.

FIG. 2 illustrates one embodiment of a completed product produced by the precast mold. The structural load capacity may be provided by the longitudinal ribs (A), while the lateral stability may be provided by transverse ribs (B). The corrugated deck panels (D) (see FIG. 1) may be locked into the ribs providing a diaphragm and a surface onto which the poured-in-place floor (J) (see FIG. 3) may be formed. The precast panel may then be shipped to the job site and erected onto some primary framing system.

FIG. 3 illustrates one embodiment of a sectional view of a completed floor system. The poured-in-place slab (J) may be cast to the desired thickness to achieve the required load capacity and fire resistance.

One embodiment of a hybrid precast concrete/metal deck panel and its method of manufacture and use will be further described below with reference to FIGS. 1–4. The embodiment of the precast concrete/metal deck panel may be manufactured in a mold capable of changing dimension to cast elements of different load carrying and spanning capacities, represented by (F), (G), (H), and (I) in FIGS. 1–4.

A precast bed (I) includes a collection of void forms (H), placed upon it in an array forming both longitudinal ribs (A) and transverse ribs (B). These void forms have a flexible filler (G) with an undulating upper surface that forms a seal with the corrugations in a metal corrugated deck (D). Onto the upper surface of the metal deck (D) may be placed a flexible filler mat (F) to prevent concrete from flowing onto the upper surface of the metal deck (D). The edges of the metal deck (D) may extend past the upper (F) and lower (G) flexible fillers to interlock into the concrete of ribs (A) and (B).

After all void forms (H) are covered, reinforcing steel may be installed in the ribs (A) and (B). Concrete may then be cast into the ribs (A) and (B), with the flexible filler (F) preventing the concrete from covering the upper surface of the metal deck (D).

The upper flexible filler (F) may include an undulating pattern on all four edges that create shear lugs (E) in the precast ribs (A) and (B) (see FIG. 4). These lugs provide a composite action with the poured-in-place topping slab (3), illustrated in FIG. 3.

After the precast concrete has gained sufficient strength, the upper flexible fillers (F) may be removed, and the panel may be removed from the mold as well. The panel may then be transported to the construction site where it can be erected onto a primary support framing. A topping slab (J) may then be poured over the entire floor to provide the desired load bearing and fire resistive capacity.

This embodiment of a type of panel combines the low weight of corrugated metal floor decking with the fire resistance and load carrying capacity of precast concrete. By taking advantage of the low weight of corrugated metal decking to provide the form for a poured-in-place floor, this panel can be manufactured and shipped more economically than existing panels that use a thin concrete slab as the form element. Because the structural beams (e.g., structural ribs) are precast concrete, for example, they do not require additional fireproofing as structural steel does.

The foregoing presentation of the described embodiments is provided to enable any person skilled in the art to make and use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A precast panel comprising:

a plurality of longitudinal concrete ribs arranged in substantially parallel fashion;

a plurality of transverse concrete ribs disposed between and extending substantially perpendicular to the longitudinal concrete ribs;

at least one void area disposed between the longitudinal ribs and transverse ribs such that the void area is bounded by at least two longitudinal ribs and at least two transverse ribs;

a metal deck panel positioned over the at least one void area and attached to least two of the longitudinal and transverse ribs to provide lateral support between the at least two of the longitudinal and transverse ribs; and wherein the least two of the longitudinal and transverse ribs to which the metal deck panel is attached include lugs formed in a top surface of the at least two of the longitudinal and transverse ribs.

2. The precast panel of claim 1, wherein the metal deck panel and the at least two of the longitudinal and transverse ribs are configured to receive a cast-in-place slab such that the cast-in-place slab interlocks with the lugs.

3. The precast panel of claim 2, wherein the cast-in-place slab includes a cast-in-place concrete floor slab.

4. The precast panel of claim 1, wherein the metal deck panel is configured to provide a form element for a cast-in-place slab.

5. The precast panel of claim 1, wherein the metal deck panel is corrugated.

* * * * *